United States Patent [19]

Reuss et al.

[11] Patent Number: 5,077,183

[45] Date of Patent: Dec. 31, 1991

[54] COLOR PHOTOGRAPHIC RECORDING MATERIAL AND A PROCESS FOR THE PREPARATION OF A PHOTOGRAPHIC SILVER HALIDE EMULSION

[75] Inventors: Helmut Reuss; Bruno Mücke, both of Bergisch Gladbach; Helmut Kampfer, Cologne, all of Fed. Rep. of Germany

[73] Assignee: Agfa Gevaert Aktiengesellschaft, Leverkusen, Fed. Rep. of Germany

[21] Appl. No.: 529,150

[22] Filed: May 25, 1990

Related U.S. Application Data

[62] Division of Ser. No. 282,201, Dec. 9, 1988, abandoned.

[30] Foreign Application Priority Data

Dec. 24, 1987 [DE] Fed. Rep. of Germany ..... 3744004

[51] Int. Cl.[5] ..... G03C 1/015; G03C 1/12; G03C 1/34

[52] U.S. Cl. ..... 430/505; 430/569; 430/570; 430/581; 430/603; 430/605; 430/607

[58] Field of Search ..... 430/506, 507, 567, 569, 430/570, 574, 591, 603, 605, 607, 505, 581

[56] References Cited

U.S. PATENT DOCUMENTS

| | | | |
|---|---|---|---|
| 3,649,286 | 3/1972 | Ogilvie | 430/570 |
| 3,713,835 | 1/1973 | Sato et al. | 430/574 |
| 3,729,319 | 4/1973 | Jefferson et al. | 430/574 |
| 3,765,899 | 10/1973 | Sato et al. | 430/574 |
| 3,769,024 | 10/1973 | Sakazume et al. | 430/574 |
| 3,865,598 | 2/1975 | Shiba et al. | 430/550 |
| 3,976,492 | 8/1976 | Hinata et al. | 430/574 |
| 3,977,880 | 8/1976 | Saito | 430/596 |
| 3,982,950 | 9/1976 | Shiba et al. | 430/567 |
| 4,425,426 | 1/1984 | Abbott et al. | 430/570 |
| 4,777,125 | 10/1988 | Delfino et al. | 430/576 |
| 4,822,726 | 4/1989 | Ikeda et al. | 430/574 |
| 4,837,140 | 6/1989 | Ikeda et al. | 430/574 |
| 4,906,558 | 3/1990 | Mücke et al. | 430/569 |

*Primary Examiner*—Charles L. Bowers, Jr.
*Assistant Examiner*—Janet C. Baxter
*Attorney, Agent, or Firm*—Connolly & Hutz

[57] ABSTRACT

Color photographic recording material having a layer support and at least one silver halide emulsion layer sensitive to blue light, in which the silver halide of the blue sensitive silver halide emulsion layer is sensitized with a blue sensitizer of the J-band type and contains at least 95 mol % of silver chloride is distinguished by high sensitivity with low fog.

6 Claims, No Drawings

COLOR PHOTOGRAPHIC RECORDING MATERIAL AND A PROCESS FOR THE PREPARATION OF A PHOTOGRAPHIC SILVER HALIDE EMULSION

CROSS REFERENCE TO RELATED APPLICATION

This application is a division of copending U.S. patent application Ser. No. 07/282,201 filed Dec. 9, 1988, now abandoned, by Helmut Reuss, Bruno Mucke, and Helmut Kampfer for Colour Photographic Material and a Process for the Preparation of a Photo Silver Halide Emulsion.

This invention relates to a colour photographic recording material having a layer support and at least one silver halide emulsion layer sensitive to blue light and to the preparation of a photographic silver halide emulsion which has a high chloride content and is distinguished by high sensitivity with low fog.

Silver halide emulsions with a high chloride content are distinguished by more rapid development and although they are considerably less sensitive than bromide emulsions they are preferred for the production of colour negative paper to shorten the process for the production of the colour copies. The low sensitivity may be improved by using silver chloride emulsions with exceptionally large grains but these slow down development and entail the problem of greater graininess.

Another method of increasing the sensitivity of silver chloride emulsions is that of chemical ripening, for example sulphur ripening, gold ripening, reduction ripening or a combination of these methods. Although this enables the sensitivity to be increased, it also increases fogging to an unacceptable extent. To overcome these disadvantages, it has been proposed to improve the sensitivity while avoiding the increased fogging by simply carrying out a sulphur ripening in the presence of a silver halide solvent. The increase in sensitivity thereby obtained is, however, slight (EP-A-72 695).

In EP-A-80 905, it is proposed to use colour negative paper in which the silver halide emulsions are composed of 90 to 99.5 mol % of chloride and 0.5 to 10 mol % of bromide and most or all of the bromide is situated on the surface of the silver halide grains. Although it is possible with these emulsions to prevent the increase in fogging normally observed in silver chloride emulsions, the sensitivity and speed of development are still in need of improvement. Another disadvantage is the flattening of the gradation.

It was an object of the present invention to provide silver halide emulsions in which the halide content consists predominantly of chloride and which can be rapidly developed and show an increase in sensitivity compared with known chloride emulsions without a concomitant increase in fogging or flattening of the gradation. It has now been found that this problem may be solved by carrying out the preparation of a silver halide emulsion with high chloride content in a particular manner.

This invention therefore relates to a process for the preparation of a silver halide emulsion containing at least 95 mol % of chloride, in which the emulsion is subjected to a sulphur, gold or combined sulphur/gold ripening after precipitation of the silver halide and optionally after physical ripening, and a blue sensitizer of the J-band type is added to the emulsion, followed by a stabilizer and, lastly, from 0.02 to 5 mol %, based on the silver content, of a halide other than chloride or a pseudohalide.

Bromide, iodide and thiocyanate are preferred halides or pseudo halides.

Thiosulphates and thioureas are examples of suitable compounds for sulphur ripening. These compounds are normally used in a quantity of from $10^{-4}$ to $10^{-6}$ mol per mol of silver halide.

The following are examples of suitable gold ripening agents: $H(AuCl_4)+KSCN$, $Na_3[Au(S_2O_3)_2]$. $2H_2O$ and gold thiocyanate. These are preferably used in a quantity of from $10^{-4}$ to $10^{-6}$ mol per mol of silver halide.

The following are examples of suitable stabilizers: azoles, e.g. benzothiazolium salts, nitroindazoles, triazoles, benzotriazoles and benzimidazoles (in particular nitro-substituted and halogen-substituted compounds); heterocyclic mercapto compounds, e.g. mercapto thiazoles, mercapto benzothiazoles, mercapto benzimidazoles, mercapto thiadiazoles, mercapto tetrazoles (especially 1-phenyl-5-mercapto tetrazole) and mercapto pyrimidines; heterocyclic mercapto compounds containing water soluble groups, e.g. a carboxyl group or a sulphone group; thioketo compounds, e.g. oxazoline thione; azaindenes, e.g. tetraazaindenes (especially 4-hydroxy-substituted (1,3,3a,7)-tetraazaindenes); benzene thiosulphonic acids and benzene sulphinic acids.

The details of such compounds and the method of using them are described, for example, in U.S. Pat. No. 3,954,474, U.S. Pat. No. 3,982,947, U.S. Pat. No. 4,021,248 and JP-OS 28 660/77.

The stabilizers may be used in particular in a quantity of from $10^{-3}$ to $10^{-6}$ mol/mol of silver halide.

The following are examples of such compounds:

Stabilizer 1

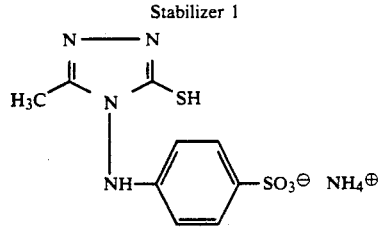

Stabilizer 2

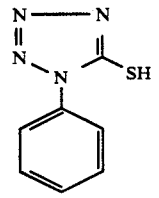

It was a further object of this invention to provide the photographic recording material mentioned above which has increased sensitivity, in particular in the blue sensitive layer. The problem is solved by sensitizing the silver halide of the blue sensitive silver halide emulsion layer with a blue sensitizer of the J-band type and using for this layer a silver halide containing at least 95 mol % of silver chloride. In a preferred photographic recording material, the silver halide of the blue sensitive silver halide emulsion layer is obtained by the process described above.

The silver halide of the blue sensitive layer preferably consists of 98 to 100 mol % of chloride, 0 to 2 mol % of bromide and 0 to 1 mol % of iodide.

The colour photographic recording material preferably contains at least one red sensitive and at least one green sensitive layer in addition to the at least one blue sensitive layer, and the blue sensitive layer is preferably arranged closer to the layer support than any other light sensitive layer. The support may be opaque and is preferably paper coated with polyethylene on both sides.

The silver halides of the green sensitive and the red sensitive layer preferably also contain at least 95 mol % of chloride, in particular 98 to 100 mol % chloride, 0 to 2 mol % bromide and 0 to 1 mol % iodide.

Spectral J-band sensitizers are known. They are compounds which, when present in silver halide emulsions, show an absorption band which is shifted by 25 to 50 nm from the M-band in the direction of longer wave lengths (J-band, see DE-A-2 156 129). They may readily be identified by suitable preliminary experiments but generally cannot be represented by a common general formula.

The J-band blue sensitizers are used in particular in a quantity of from $10^{-3}$ to $10^{-6}$ mol/mol of silver halide.

Suitable compounds are shown below:

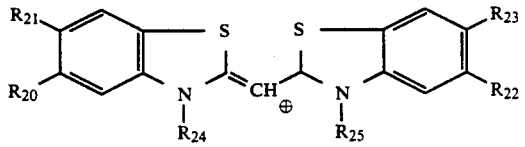

| Sensitizer No. | $R_{20}$ | $R_{21}$ | $R_{22}$ | $R_{23}$ | $R_{24}$ | $R_{25}$ | J-Band [nm] |
|---|---|---|---|---|---|---|---|
| 1 | Cl | H | Cl | H | $(CH_2)_3SO_3^{\ominus}$ | $(CH_2)_3SO_3^{\ominus}(C_2H_5)_3\overset{\oplus}{N}H$ | 470 |
| 2 | Cl | H | Cl | H | $(CH_2)_4SO_3^{\ominus}$ | $(CH_2)_4SO_3^{\ominus}(C_2H_5)_3\overset{\oplus}{N}H$ | 470 |
| 3 | H | H | H | H | $CH_3$ | $CH_3CH_3SO_4^{\ominus}$ | 460 |
| 4 | $CH_3O$ | H | $CH_3O$ | H | $(CH_2)_3SO_3^{\ominus}$ | $(CH_2)_3SO_3^{\ominus}(C_2H_5)_3\overset{\oplus}{N}H$ | 473 |
| 5 | $CH_3$ | $CH_3O$ | $CH_3$ | $CH_3O$ | $C_2H_5$ | $(CH_2)_3SO_3^{\ominus}$ | 480 |
| 6 | $CH_3O$ | H | Cl | H | $C_2H_5$ | $CH_2CH_2CH(CH_3)SO_3^{\ominus}$ | 475 |
| 7 | $CH_3$ | H | $CH_3$ | H | $CH_3$ | $(CH_2)_3SO_3^{\ominus}$ | 465 |
| 8 | $CH_3$ | $CH_3$ | H | H | $C_2H_5$ | $(CH_2)_3SO_3^{\ominus}$ | 465 |

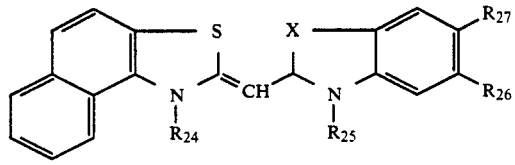

| No. | X | $R_{26}$ | $R_{27}$ | $R_{24}$ | $R_{25}$ | J-Band [nm] |
|---|---|---|---|---|---|---|
| 9 | S | H | H | $(CH_2)_3SO_3^{\ominus}$ | $(CH_2)_3SO_3^{\ominus}(C_2H_5)_3\overset{\oplus}{N}H$ | 482 |
| 10 | S | H | H | $C_2H_5$ | $(CH_2)_3SO_3^{\ominus}$ | 482 |
| 11 | S | H | H | $C_2H_5$ | $CH_2CH_2CH(CH_3)SO_3^{\ominus}$ | 483 |
| 12 | S | $CH_3O$ | H | $(CH_2)_3SO_3^{\ominus}$ | $C_2H_5$ | 488 |
| 13 | S | $CH_3$ | $CH_3O$ | $(CH_2)_3SO_3^{\ominus}$ | $C_2H_5$ | 494 |
| 14 | S | Cl | H | $(CH_2)_3SO_3^{\ominus}$ | $(CH_2)_3SO_3Na$ | 482 |
| 15 | Se | $CH_3O$ | H | $(CH_2)_3SO_3^{\ominus}$ | $(CH_2)_4SO_3Na$ | 490 |
| 16 | Se | $CH_3O$ | H | $C_2H_5$ | $(CH_2)_3SO_3^{\ominus}$ | 490 |

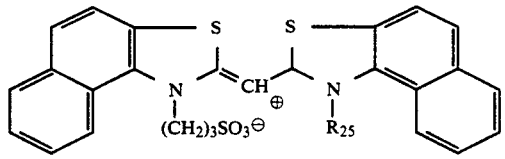

| | | J-Band [nm] |
|---|---|---|
| 17 | $R_{25} = C_2H_5$ | 495 |
| 18 | $R_{25} = (CH_2)_3SO_3^{\ominus}(C_2H_5)_3NH$ | 495 |
| 19 | 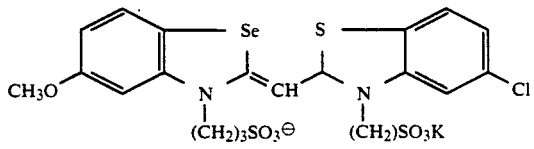 | 480 |

-continued

20 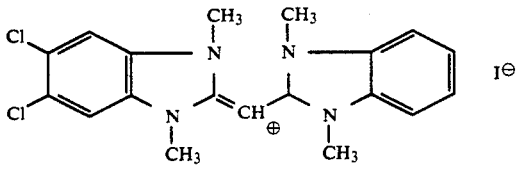 440

21 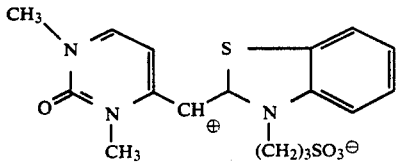 485

Binders and silver halide grains are essential components of the at least one blue sensitive layer.

The binder used is preferably gelatine but this may be partly or completely replaced by other polymers which, may be synthetic, semi-synthetic or naturally occurring. Examples of synthetic gelatine substitutes include polyvinyl alcohol, poly-N-vinyl pyrolidone, polyacrylamides, polyacrylic acid and their derivatives, especially their copolymers. Examples of naturally occurring gelatine substitutes include proteins other than gelatine, such as albumin or casein, cellulose, sugar, starch and alginates. Semi-synthetic gelatine substitutes are generally modified natural products. Cellulose derivatives such as hydroxyalkyl cellulose, carboxymethyl cellulose and phthalyl cellulose as well as gelatine derivatives which have been obtained by a reaction with alkylating or acylating agents or by the grafting of polymerisable monomers are examples of such products.

The binders should contain a sufficient quantity of functional groups to give rise to sufficiently resistant layers when reacted with suitable hardeners. Amino groups are particularly suitable functional groups for this purpose but carboxyl groups, hydroxyl groups and active methylene groups are also suitable.

Gelatine, which is the binder preferably used, may be obtained by acid or alkaline decomposition. The preparation of such gelatines is described, for example, in the Science and Technology of Gelatine, published by A. G. Ward and A. Courts, Academic Press 1977, page 295 et sec. Whichever gelatine is used, it should be as free as possible from photographically active impurities (inert gelatine). Gelatines with a high viscosity and low swelling are particularly advantageous.

The silver halide grains may be predominantly compact crystals, e.g. with a regular cubical or octahedric or transition form. Platelet shaped crystals are also suitable; these preferably have an average ratio of diameter to thickness greater than 5:1, the diameter of a grain being defined as the diameter of a circle whose area is equal to the projected surface area of the grain.

The silver halide grains may also have a multi-layered structure, in the simplest case with an inner and an outer region (core/shell) which differ from one another in their halide composition and/or other modifications, such as doping. The average grain size of the emulsions is preferably from 0.2 μm to 2.0 μm and the grain size distribution may be either homodisperse or heterodisperse. A homodisperse grain distribution means that 95% of the grains differ by not more than ±30% from the average grain size. The emulsions may contain organic silver salts in addition to silver halide, e.g. silver benzotriazolate or silver behenate.

Two or more types of silver halide emulsions which are prepared separately may be used as a mixture.

The photographic emulsions may be prepared from soluble silver salts and soluble halides by various methods (e.g. P. Glafkides, Chimie et Physique Photographique, Paul Montel, Paris (1967), G. F. Duffin, Photographic Emulsion CHemistry, The Focal Press, London (1966), V. L. Zelikman et al, Making and Coating Photographic EMulsions, The Focal Press, London (1966)).

Precipitation of the silver halide is preferably carried out in the presence of the binder, e.g. gelatine, and may be carried out at an acid, neutral or alkaline pH, and silver halide complex formers are advantageously present. The latter include e.g. ammonia, thioethers, imidazole, ammonium thiocyanate and excess halide. The water soluble silver salts and the halides are preferably introduced into the process successively by the single jet process or simultaneously by the double jet process or by any combination of the two methods. Doping with increasing inflow rates is preferred, but the "critical" inflow rate at which new nuclei are just prevented from forming should not be exceeded. The pAg range may vary within wide limits during the precipitation. The so called pAg controlled process is preferably employed, in which the pAg value is kept constant at a particular value or passes through a specified pAg profile during precipitation. Instead of the preferred method of precipitation with a halide excess, so called inverse precipitation with a silver ion excess may be employed. The silver halide crystals may be formed not only by precipitation but also by physical ripening (Ostwald ripening) in the presence of excess halide and/or silver halide complex forming agents. The growth of emulsion grains may in fact take place predominantly by Ostwald ripening, for which a fine grained, so called Lippmann emulsion is preferably mixed with a less soluble emulsion and redissolved and precipitated on the latter.

Salts or complexes of metals such as Cd, Zn, Pb, Tl, Bi, Ir, Rh or Fe may be present during precipitation and/or physical ripening of the silver halide grains.

Precipitation may also be carried out in the presence of sensitizing dyes. Complex forming agents and/or dyes may be rendered inactive at any time, e.g. by altering the pH or by an oxidative treatment.

The soluble salts are removed from the emulsion after crystal formation has been completed or at an earlier stage, e.g. by shredding and washing, by flocculation and washing, by ultra filtration or by means of an ion exchanger.

The silver halide emulsions are generally subjected to a chemical sensitization under specified conditions of pH, pAg, temperature and concentration of gelatine, silver halide and sensitizer, until the optimum sensitivity and fogging are reached. The procedure has been described, for example, in H. Frieser "Die Grundlagen der Photographischen Prozesse mit Silberhalogeniden", pages 675 to 734, Akademische Verlagsgesellschaft (1968).

Chemical sensitization may be carried out in addition to the above described sulphur and/or gold ripening by the addition of compounds of selenium or tellurium and/or compounds of metals of subgroup VIII of the periodic system (e.g. platinum, palladium or iridium) and thiocyanate compounds, surface active compounds such as thioethers, heterocyclic nitrogen compounds (e.g. imidazoles or azaindenes) or spectral sensitizers (described e.g. in F. Hamer, "The Cyanine Dyes and Related Compounds", 1964, and Ullmanns Encyclopadie der Technischen Chemie, 4th edition, volume 18, page 431 et seq. and Research Disclosure number 17643, Section III) may also be added. A reduction sensitization may also be carried out by the addition of reducing agents (tin-II salts, amines, hydrazine derivatives, amino boranes, silanes, formamidine sulphinic acid) and using hydrogen, a low pAg (e.g. below 5) and/or a high pH (e.g. above 8).

The blue sensitive emulsions are preferably chemically sensitized by the process according to the invention. Emulsions which have been sensitized to a different colour may also be ripened by the process according to the invention.

The photographic emulsions may contain compounds for preventing fogging or for stabilizing the photographic function during production, storage or photographic processing.

Azaindenes are particularly suitable, especially tetra and pentaazaindenes, and especially those which are substituted with hydroxyl or amino groups. Compounds of this type have been described, e.g. by Birr in Z. Wiss. Phot. 47 (1952), pages 2 to 58. Salts of metals such as mercury or cadmium, aromatic sulphonic or sulphinic acids such as benzene sulphinic acid and nitrogen-containing heterocyclic compounds such as nitrobenzimidazole, nitroindazole, (substituted) benzotriazoles or benothiazolium salts may be used as anti-foggants. Heterocyclic compounds containing mercapto groups are particularly suitable, e.g. mercapto benzothiazoles, mercapto benzimidazoles, mercapto tetrazoles, mercapto thiadiazoles and mercapto pyrimidines. These mercapto azoles may also contain a water solubilizing group, e.g. a carboxyl group or a sulpho group. Other suitable compounds are published in Research Disclosure number 17643 (1978), section VI.

The stabilizers may be added to the silver halide emulsions before, during or after ripening. The compounds may, of course, also be added to other photographic layers which are associated with a silver halide layer.

Mixtures of two or more of the above mentioned compounds may be used.

The photographic emulsion layers or other hydrophilic colloid layers of the light sensitive material prepared according to the invention may contain surface active agents for various purposes, such as coating auxiliaries, for preventing electric charging, for improving the slip properties, for emulsifying the dispersion, for preventing adhesion and for improving the photographic characteristics (e.g. development acceleration, high contrast, sensitization, etc.).

The photographic emulsions may be spectrally sensitized with methine dyes or other dyes. Cyanine dyes, merocyanine dyes and complex merocyanine dyes are particularly suitable. The blue sensitive layer is, of course, sensitized in accordance with the invention.

Colour photographic materials normally contain at least one red sensitive, one green sensitive and one blue sensitive emulsion layer. These emulsion layers have non-diffusible monomeric or polymeric colour couplers associated with them, which may be situated in the same layer or in an adjacent layer. Cyan couplers are normally associated with the red sensitive layers, magenta couplers with the green sensitive layers and yellow couplers with the blue sensitive layers.

Colour couplers for producing the cyan partial colour image are generally couplers of the phenol or α-naphthol series. Suitable examples of these are known from the literature.

Colour couplers for producing the yellow partial colour image are generally couplers containing an open chain ketomethylene group, in particular couplers of the type of α-acyl acetamide. Suitable examples of these are the α-pivaloyl acetanilide couplers, which are also known from the literature.

Colour couplers for producing the magenta partial colour image are generally couplers from the series of 5-pyrazolone, indazolone or pyrazolo-azole. Large numbers of suitable examples of these are described in the literature.

The colour couplers may be 4-equivalent couplers or 2-equivalent couplers. The latter are derived from the 4-equivalent couplers in that they carry in the coupling position a substituent which is split off in the coupling reaction. The 2-equivalent couplers include those which are colourless as well as those which have an intense colour of their own which disappears in the process of colour coupling to be replaced by the colour of the resulting image dye (masking couplers), and they also include white couplers which give rise to substantially colourless products when they react with colour developer oxidation products. The 2-equivalent couplers also include couplers in which a removable group is situated in the coupling position. This group is released in the reaction with colour developer oxidation products to unfold a particular desired photographic activity, e.g. as development inhibitor or accelerator, either directly or after one or more further groups have been split off from the original removable group (e.g. DE-A-27 03-145, DE-A-28 55 697, DE-A-31 05 026, DE-A-33 19 428). Examples of such 2-equivalent couplers include the known DIR couplers as well as DAR and FAR couplers.

Since the importance of the DIR, DAR and FAR couplers lies mainly in the activity of the group released in the coupling position and less in the colour forming properties of the couplers, it is also suitable to use DIR, DAR and FAR couplers which give rise to substantially colourless products in the coupling reaction (DE-A-1 547 640).

The group split off may also be a ballast group so that the reaction with colour developer oxidation products gives rise to coupling products which are diffusible or at least have a weak or limited mobility (U.S. Pat. No. 4,420,556).

High molecular weight colour couplers are described, for example, in DE-C-1 297 417, DE-A-24 07 569, DE-A-31 48 125, DE-A-32 17 200, DE-A-33 20 079, DE-A-33 24 932, DE-A-33 31 743, DE-A-33 40 376, EP-A-27 284 and U.S. Pat. No. 4,080,211. The high molecular weight colour couplers are generally prepared by polymerisation of ethylenically unsaturated, monomeric colour couplers but they may also be obtained by polyaddition or polycondensation.

Incorporation of couplers or other compounds in silver halide emulsion layers may be carried out by first preparing a solution, dispersion or emulsion of the particular compound and then adding this to the casting solution for the layer in which it is required. The choice of a suitable solvent or dispersing agent depends on the solubility of the particular compound.

Methods of introducing substantially water-insoluble compounds by grinding processes are described, for example in DE-A-2 609 741 and DE-A-2 609 742.

Hydrophobic compounds may also be introduced into the casting solution by means of high boiling solvents, so called oil formers. Suitable methods are described, for example, in U.S. Pat. No. 2,322,027, U.S. Pat. No. 2,801,170, U.S. Pat. No. 2,801,171 and EP-A-0 043 037.

Oligomers or polymers, so called polymeric oil formers, may be used instead of the high boiling solvents.

The compounds may also be introduced into the casting solution in the form of charged latices. See, for example, DE-A-2 541 230, DE-A-2 541 274, DE-A-2 835 836, EP-A-0 014 921, EP-A-0 069 671, EP-A-0 130 115 and U.S. Pat. No. 4,291,113.

The diffusion fast incorporation of anionic, water soluble compounds (e.g. dyes) may also be carried out by means of cationic polymers, so called mordanting polymers.

Examples of suitable oil formers include phthalic acid alkyl esters, phosphoric acid esters, citric acid esters, benzoic acid esters, alkylamide, fatty acid esters and trimesic acid esters.

A colour photographic material typically includes at least one red sensitive emulsion layer, at least one green sensitive emulsion layer and at least one blue sensitive emulsion layer on a support. The order in which these layers are arranged may be varied as desired. Couplers which form cyan, magenta and yellow dyes are normally incorporated in the red sensitive, green sensitive and blue sensitive emulsion layers, respectively, but other combinations may also be employed.

Each of the light sensitive layers may consist of a single layer or it may be composed of two or more silver halide emulsion part layers (DE-C-1 121 470). Red sensitive silver halide emulsion layers are frequently arranged closer to the layer support than green sensitive silver halide emulsion layers which in turn are arranged closer to the support than blue sensitive layers, and the green sensitive layers are generally separated from the blue sensitive layers by a light insensitive yellow filter layer.

If the green sensitive and the red sensitive layers have a sufficiently low intrinsic sensitivity, the yellow filter layer may be dispensed with and a different layer arrangement may be employed, for example the blue sensitive layers may be arranged closest to the support, and these may be followed by the red sensitive layers and finally the green sensitive layers.

The light insensitive interlayers generally arranged between layers which differ in their spectral sensitivity may contain substances which prevent unwanted diffusion of developer oxidation products from one light sensitive layer to another light sensitive layer of a different spectral sensitization.

When a material contains several part layers of the same spectral sensitization, these may differ from one another in their composition, in particular in the nature and quantity of the silver halide grains. The part layer which has the higher sensitivity is generally arranged further away from the support than the part layer with the lower sensitivity. Part layers of the same spectral sensitization may be arranged adjacent to one another or they may be separated by other layers, e.g. by layers of a different spectral sensitization. Thus, for example, all highly sensitive layers may be combined in one layer packet and all less sensitive layers in another (DE-A 1 958 709, DE-A 2 530 645, DE-A 2 622 922).

The photographic material may also contain UV-light absorbent compounds, white toners, spacers, filter dyes, formalin acceptors and others.

UV light absorbent compounds are required to protect the image dyes against bleaching by daylight with a high UV content and they are also required to act as filter dyes to absorb the UV light present in daylight at the time of exposure and thereby improve the colour reproduction of a film. Compounds with different structures are normally used for the two different purposes. Examples of UV absorbent compounds include aryl-substituted benzotriazole compounds (U.S. Pat. No. 3,533,794), 4-thiazolidone compounds (U.S. Pat. Nos. 3,314,794 and 3,354,681), benzophenone compounds (JP-A 2784/71), cinnamic acid ester compounds (U.S. Pat. Nos. 3,705,805 and 3,707,375), butadiene compounds (U.S. Pat. No. 4,045,229) and benoxazole compounds (U.S. Pat. No. 3,700,455).

Ultraviolet absorbent couplers (such as cyan couplers of the $\alpha$-naphthol series) and ultraviolet absorbent polymers may also be used. These ultraviolet absorbents may be fixed in a particular layer by means of mordants.

Filter dyes suitable for visible light include oxonole dyes, hemioxonole dyes, styrene dyes, merocyanine dyes, cyanine dyes and azo dyes. Among these, oxonole dyes, hemioxonole dyes and merocyanine dyes are particularly advantageous.

Suitable white toners are described, e.g. in Research Disclosure 17643, December 1978, chapter V, page 22 et seq.

Photographically inert particles of an inorganic or organic nature serving e.g. as matting agents or as spacers may be contained in certain layers of binders, especially those which are furthest removed from the support, but occasionally also in interlayers, especially if they are furthest removed from the support in the course of their preparation (DE-A 3 331 542, DE-A 3 424 893, Research Disclosure December 1978, page 22 et sec, Report 17643, chapter XVI).

The average particle diameter of the spacers is mainly in the range of from 0.2 to 10 $\mu$m. The spacers are insoluble in water and may be soluble or insoluble in alkalis. Those which are alkali soluble are generally removed from the photographic material by the alkaline development bath. Polymethyl methacrylate, copolymers of acrylic acid and methyl methacrylate and hydroxypropyl methyl cellulose hexahydrophthalate are examples of suitable polymers.

The binders of the material according to the invention are hardened with suitable hardeners, especially when the binder used is gelatine. These hardeners may be of the epoxide type, the ethylene imine type or the acryloyl type or the vinyl sulphone type. Hardeners of the diazine, triazine and 1,2-dihydroquinoline series are also suitable.

The binders of the material according to the invention are preferably hardened with instant hardeners.

Instant hardeners are compounds which effect cross-linking of suitable binders so rapidly that hardening is completed to such an extent immediately after casting or at the latest after 24 hours and preferably after not more than 8 hours that no further change in sensitometry or swelling of the combination of layers can take place as a result of a cross-linking reaction. The swelling is the difference between the wet layer thickness and the dry layer thickness when a film is processed under aqueous conditions (Photographic Sci. Eng. 8 (1964), 275; Photographic Sci. Eng. (1972) 449).

Examples of these hardeners which effect very rapid hardening of gelatine include carbamoyl pyridinium salts, which are capable of reacting with the free carboxyl groups of gelatine so that the latter react with free amino groups of gelatine to form peptide bonds and effect cross-linking of the gelatine.

Compounds corresponding to the following general formulae are examples of suitable instant hardeners:

(a)

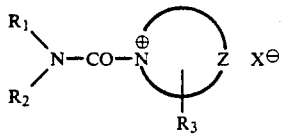

wherein $R_1$ denotes alkyl, aryl or aralkyl, $R_2$ has the same meaning as $R_1$ or it denotes alkylene, arylene, aralkylene or alkaralkylene in which the second bond may be linked to a group of the following formula

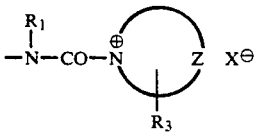

or $R_1$ and $R_2$ may together denote the atoms required for completing an optionally substituted heterocyclic ring, for example a piperidine, piperazine or morpholine ring, which ring may be substituted, e.g. by $C_1$ to $C_3$ alkyl or by halogen, $R_3$ denotes hydrogen, alkyl, aryl, alkoxy, $—NR_4—COR_5$, $—(CH_2)_m—NR_8R_9$, $—(CH_2)_n—CONR_{13}R_{14}$ or $—(CH_2)_p—$ $$\begin{array}{l} CH—Y—R_{16} \\ | \\ R_{15} \end{array}$$

or a bridging member or a direct link to a polymer chain, $R_4$, $R_6$, $R_7$, $R_9$, $R_{14}$, $R_{15}$, $R_{17}$, $R_{18}$ and $R_{19}$ in the above formulae denoting hydrogen or $C_1$ to $C_4$ alkyl while $R_5$ denotes hydrogen, $C_1$ to $C_4$ alkyl or $NR_6R_7$, $R_8$ denotes $COR_{10}$, $R_{10}$ denotes $NR_{11}R_{12}$, $R_{11}$ denotes $C_1$ to $C_4$ alkyl or aryl, in particular phenyl, $R_{12}$ denotes hydrogen, $C_1$ to $C_4$ alkyl or aryl, in particular phenyl, $R_{13}$ denotes hydrogen, $C_1$ to $C_4$ alkyl or aryl, in particular phenyl, $R_{16}$ denotes hydrogen, $C_1$ to $C_4$ alkyl, $COR_{18}$ or $CONHR_{19}$, m stands for a number from 1 to 3, n stands for a number from 0 to 3, p stands for a number from 2 to 3 and Y denotes 0 or $NR_{17}$ or $R_{13}$ and $R_{14}$ together denote the atoms required for completing an optionally substituted heterocyclic ring, for example a piperidine, piperazine or morpholine ring, which ring may be substituted, e.g. by $C_1$ to $C_3$ alkyl or by halogen, Z denotes the carbon atoms required for completing a 5 membered or 6 membered aromatic heterocyclic ring optionally carrying a condensed benzene ring, and $X^{\ominus}$ denotes an anion, which is absent when an anionic group is already attached to the remainder of the molecule; and (b)

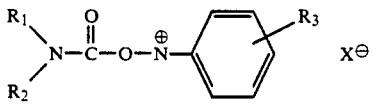

wherein $R_1$, $R_2$, $R_3$ and $X^{\ominus}$ have the meaning indicated for formula (a).

The colour photographic materials according to the invention are treated in the usual manner by the processes recommended for such materials.

EXAMPLE 1

A monodisperse silver chloride emulsion having a grain size of 0.8 μm was prepared by the double inflow of an $AgNO_3$ and and NaCl solution containing $Na_4IrCl_6$. The Ir content was $0.05\times10^{-6}$ mol/mol of Ag. The emulsion was flocculated, washed and redispersed with gelatine in the usual manner. The ratio by weight of gelatine to silver (as $AgNO_3$) was 0.5. The AgCl content was 1 mol per kg of emulsion.

The emulsion was then divided into four equal parts and ripened to optimum sensitivity as follows:

Part 1 with $20\times10^{-6}$ mol of thiosulphate per mol of Ag

Part 2 with $20\times10^{-6}$ mol of thiosulphate and $2\times10^{-6}$ mol of $HAuCl_4$ per mol of Ag.

After ripening, the emulsions were sensitized to the blue region of the spectrum with blue sensitizer 1 ($400\times10^{-6}$ mol/mol Ag) and then stabilized with stabilizer 1 ($243\times10^{-6}$ mol/mol Ag).

Part 3 was ripened and sensitized in the same manner as part 2 but with the addition of 1 mol % of KBr solution, based on the total silver content, before compound 1 was added.

Part 4 was prepared in the same manner as part 2 except that 1 mol % of KBr solution, based on the total silver content, was added after stabilization.

EXAMPLE 2

A silver chloride emulsion having an average particle size of 0.25 μm was prepared within 15 minutes by simultaneous pAg-controlled inflow of a NaCl solution and an $AgNO_3$ solution to a 2.1% by weight gelatine solution which had been heated to 63° C. The crystals of this starting emulsion were then increased in size to twice their diameter by the further addition of KCl, KBr and $AgNO_3$ solutions at pAg 6.0. An AgCl shell was then precipitated on the crystals by pAg controlled double inflow of KCl and $AgNO_3$ solutions. The average particle diameter of the resulting crystals was 0.80 μm. 15% of the crystals were outside the range of 0.80±(0.1–0.80 μm), i.e. the emulsion obtained was homodisperse. The total bromide content was 1 mol %.

The crystals contained an inner AgCl core (47% of the crystal volume) around which was a layer of AgClBr (6% of the crystal volume) and a shell of AgCl (47% of the crystal volume).

The emulsions were flocculated, washed and redispersed with gelatine in the usual manner. The ratio by weight of gelatine to silver (as $AgNO_3$) was 0.5. The silver halide content was 1 mol per kg of emulsion.

The emulsion was then chemically ripened to optimum sensitivity with $2.9\times10^{-6}$ mol of compound $Na_3[Au(S_2O_3)_2]\cdot 2\,H_2O$ in the presence of $290\times10^{-6}$ mol of sensitizer 1 and $75\times10^{-6}$ mol of the sensitizer 22 described below. All figures given in terms of mol are based on 1 mol of Ag.

The emulsion was then divided into four parts and treated as follows:

Part 5 was stabilized with stabilizer 1 ($243\times10^{-6}$ mol/mol Ag).

Part 6 was stabilized in the same way as part 5 but 0.5 mol % of a KBr solution, based on the total silver content, was then added.

Part 7 was stabilized in the same way as part 5 and 0.5 mol % of a KBr solution and 0.1 mol % of a KI solution, based on the total silver content, were then added.

Part 8 0.5 mol % of a KBr solution, based on the total silver content, was added and part 8 was then stabilized in the same manner as part 5.

0.95 g of yellow coupler Y-1 (see Example 3) per 0.65 g of $AgNO_3$ were added to parts 1 to 4 of the emulsion from Example 1 and to parts 5 to 8 of the emulsion from Example 2 and the emulsions were then cast on a layer support of paper which was coated with polyethylene on both sides. A gelatine layer containing 5% by weight of the hardener corresponding to the following formula

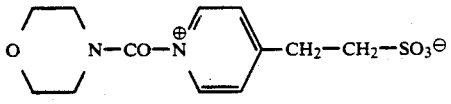

was then cast. The silver application was 0.65 g $AgNO_3/m^2$. The hardening layer was applied in a quantity corresponding to 1 g of gelatine per $m^2$.

The layers were dried, exposed image wise and processed with Ektacolour RA4-chemicals by the Ektacolour RA4 short process.

The results are entered in Tables 1 and 2.

Example 1 demonstrates that the sensitivity is increased by the addition of Au for chemical ripening. There is a marked increase in fog, both in the fresh sample and above all after storage in the heating cupboard (3 days, 54° C.).

An enormous increase in sensitivity of the blue sensitized silver chloride emulsion is obtained by the addition of KBr. For achieving optimum results it is essential to add the potassium bromide in the correct sequence. It is only by adding it after the stabilizer that a low fog and steep gradation are ensured.

Example 2 demonstrates that silverchlorobromide emulsions which contain the bromide in the interior of the crystal have a very low sensitivity if no halide other than chloride is subsequently added. Here again, optimum results can only be obtained when bromide or bromide and iodide are added after the stabilizer.

TABLE 1

| | | D Min | | Gamma | | |
|---|---|---|---|---|---|---|
| | $E_{rel}$ | Fresh | After storage | 1 | 2 | $D_{max}$ |
| 1 | 100 | 0.120 | 0.135 | 2.20 | 3.52 | 2.75 |
| 2 | 150 | 0.160 | 0.270 | 2.00 | 5.20 | 2.77 |
| 3 | 225 | 0.175 | 0.190 | 1.43 | 3.24 | 2.80 |
| 4 | 263 | 0.130 | 0.145 | 1.87 | 4.15 | 2.70 |

TABLE 2

| | | D Min | | Gamma | | |
|---|---|---|---|---|---|---|
| | $E_{rel}$ | Fresh | After storage | 1 | 2 | $D_{max}$ |
| 5 | 100 | 0.124 | 0.152 | 1.67 | 3.72 | 2.68 |
| 6 | 240 | 0.111 | 0.127 | 1.94 | 3.85 | 2.81 |
| 7 | 263 | 0.137 | 0.170 | 1.81 | 4.89 | 2.56 |
| 8 | 202 | 0.142 | 0.158 | 1.52 | 3.10 | 2.75 |

In these tables, gamma 1 is the gradient of the straight line between density 0.2 and density 0.8 above fog; gamma 2 is the gradient of the straight line between density 0.8 and 1.6 above fog in the D/logIt graph.

Blue sensitizer 22

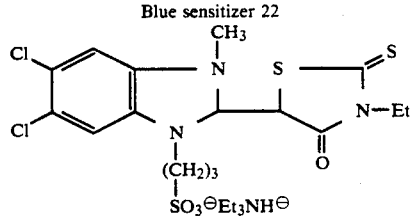

EXAMPLE 3

A colour photographic recording material was prepared by applying the following layers in the sequence given to a layer support of paper coated with polyethylene on both sides. The quantities are all based on 1 $m^2$. The amount of silver halide applied is given in terms of the corresponding quantities of $AgNO_3$.

Layer arrangement 1:

First layer (substrate layer):

0.2 g gelatine

Second layer (blue sensitive layer):

blue sensitive silver halide emulsion Example 1, part 2, containing:

0.63 g $AgNO_3$ 1.38 g gelatine 0.95 g yellow coupler Y-1

0.2 g white coupler W-1

0.29 g tricresyl phosphate (TCP)

Third layer (protective layer):
- 1.1 g gelatine
- 0.06 g 2,5-dioctylhydroquinone
- 0.06 g dibutyl phthalate (DBP)

Fourth layer (green sensitive layer):
- green sensitized silver halide emulsion (99.5 mol % chloride, 0.5 mol % bromide, average grain diameter 0.6 μm) obtained from 0.45 g $AgNO_3$ with
  - 1.08 g gelatine
  - 0.41 g magenta coupler M-1
  - 0.16 g α-(3-t-butyl-4-hydroxyphenoxy)-myristic acid ethyl ester
  - 0.08 g 2,5-dioctylhydroquinone
  - 0.34 g DBP
  - 0.04 g TCP Fifth layer (UV protective layer):
- 1.15 g gelatine
- 0.6 g UV absorbent corresponding to the following formula

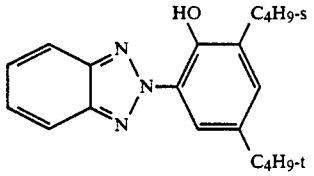

- 0.045 g 2,5-dioctylhydroquinone
- 0.04 g TCP

Sixth layer (red sensitive layer):
- red sensitized silver halide emulsion (99.5 mol % chloride, 0.5 mol % bromide, average grain diameter 0.5 μm) from 0.3 g $AgNO_3$ with
  - 0.75 g gelatine
  - 0.36 g cyan coupler C-1
  - 0.36 g TCP Seventh layer (UV protective layer):
- 0.35 g gelatine
- 0.15 g UV absorbent as in fifth layer
- 0.2 g TCP Eighth layer (protective layer):
- 0.9 g gelatine
- 0.3 g hardener H-15 corresponding to the following formula

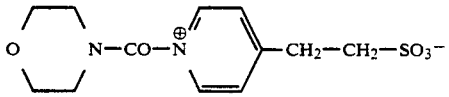

Formulae of the couplers used:

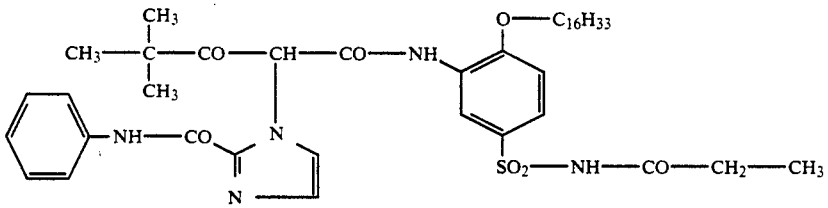

Y-1

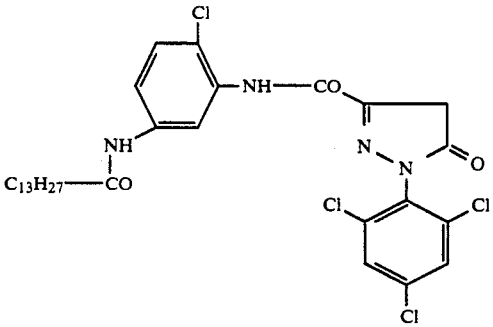

M-1

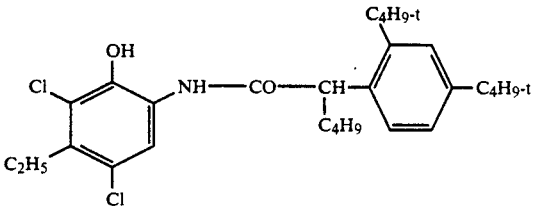

C-1

-continued

W-1

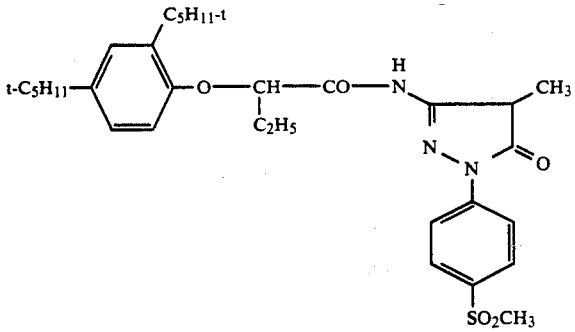

Layer combination 2:

Same as layer combination 1 but with the blue sensitive silver halide emulsion of Example 1, part 3.

Layer combination 3:

Same as layer combination 1 but with the blue sensitive silver halide emulsion of Example 1, part 4.

The layer combinations were exposed behind a blue filter and processed by the Ektacolour RA4 rapid process.

The following table shows the advantages of the emulsion according to the invention in the blue sensitive layer of layer combination 3.

| Layer Combination | Emulsion | log i.t | $D_{min}$ | Gamma 1 | Gamma 2 |
|---|---|---|---|---|---|
| 1 | Example 1 Part 2 | 1.42 | 0.245 | 1.79 | 3.40 |
| 2 | Example 2 Part 3 | 1.71 | 0.175 | 1.55 | 2.45 |
| 3 | Example 1 Part 4 | 1.88 | 0.116 | 1.93 | 3.33 |

We claim:

1. Process for the preparation of a silver halide emulsion containing at least 95 mol % chloride, wherein after precipitation of the silver halide and optionally after physical ripening, the emulsion is subjected to a sulphur, gold or combined sulphur/gold ripening, and a blue sensitizer of the J-band type is added to the emulsion, followed by stabilization with a stabilizer and, subsequent to said stabilization, adding from 0.02 to 5 mol %, based on the silver of a halide other than chloride or a psuedo-halide.

2. A process as claimed in claim 1 wherein the blue sensitive silver halide emulsion layer contains from 0.02 to 5 mol %, based on the silver, of a halide which is different from chloride, a pseudo halide or any mixtures of halides other than chloride and pseudo halides.

3. Process according to claim 2, characterised in that the pseudo halides and the halides other than chloride used are bromide, iodide and thiocyanate.

4. Process according to claim 1, characterised in that thiosulphates or thioureas are used for the sulphur ripening.

5. Process according to claim 1, characterised in that the agents for sulphur ripening are used in a quantity of from $10^{-4}$ to $10^{-6}$ mol per mole of silver halide.

6. Color photographic recording material having a layer support and at least one silver halide emulsion layer sensitive to blue light, characterised in that the silver halide of the blue sensitive silver halide emulsion layer is sensitized with a blue sensitizer of the J-band type and consists to an extent of at least 95 mole % of silver chloride wherein the light sensitive silver halide emulsion of the blue sensitive silver halide emulsion layer is obtainable by a process in which after precipitation of the silver halide containing at least 95 mol % chloride and optionally after physical ripening, the emulsion is subject to a sulphur, gold or combined sulphur/gold ripening and a blue sensitizer of the type J-band is added to the emulsion, followed by stabilization with a stabilizer and, subsequent to said stabilization, adding from 0.02 to 5 mol %, based on the silver of a halide other than chloride or a psuedo-halide.

* * * * *